US012752162B2

(12) United States Patent
Breier et al.

(10) Patent No.: US 12,752,162 B2
(45) **Date of Patent: *Oct. 6, 2026**

(54) VARIABLE BOUNCE AND HEEL RELIEF FOR IRONS

(71) Applicant: Acushnet Company, Fairhaven, MA (US)

(72) Inventors: Joshua G. Breier, Vista, CA (US); Marni D. Ines, San Marcos, CA (US); Joseph John Van Wezenbeeck, Oceanside, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 314 days.

This patent is subject to a terminal disclaimer.

(21) Appl. No.: 18/584,805

(22) Filed: Feb. 22, 2024

(65) Prior Publication Data

US 2024/0189671 A1 Jun. 13, 2024

Related U.S. Application Data

(63) Continuation of application No. 17/886,052, filed on Aug. 11, 2022, now Pat. No. 11,931,629.

(51) Int. Cl.
*A63B 53/04* (2015.01)

(52) U.S. Cl.
CPC ..... *A63B 53/0433* (2020.08); *A63B 53/047* (2013.01); *A63B 2053/0479* (2013.01)

(58) Field of Classification Search
CPC ..... A63B 53/0433; A63B 53/047; A63B 2053/0475; A63B 2053/0479; A63B 2053/0483
See application file for complete search history.

(56) References Cited

U.S. PATENT DOCUMENTS 5,312,105 A * 5/1994 Cleveland ..... A63B 53/047 473/350
5,326,105 A * 7/1994 Fenton, Jr. ..... A63B 53/047 473/328

(Continued)

FOREIGN PATENT DOCUMENTS

CA 2312587 A1 * 12/2000 ..... A63B 53/06
EP 2868353 A2 * 5/2015 ..... A63B 53/047

(Continued)

OTHER PUBLICATIONS

Japan Patent Office, Japanese Office Action dated Aug. 21, 2024, Application No. 2023-108700, 14 pages.

*Primary Examiner* — Alvin A Hunter
(74) *Attorney, Agent, or Firm* — Cislo & Thomas LLP

(57) ABSTRACT

A golf club head with an improved sole profile is disclosed herein. More specifically, the present invention discloses various types of irons, including wedges, having a toe portion, a heel portion, and a center portion therebetween, in which a camber radius of a sole as measured from a front to a back of the golf club head changes moving from the toe portion through the center portion to the heel portion. In addition, a bounce angle of the golf club head also changes moving from the toe portion through the center portion to the heel portion. The resulting golf club head improves performance, as this new sole profile allows specific portions of the sole to have a profile that meets the needs at that location.

26 Claims, 5 Drawing Sheets

(56) References Cited

U.S. PATENT DOCUMENTS

| | | | | |
|---|---|---|---|---|
| 7,393,286 | B1 * | 7/2008 | Renegar | A63B 53/047 473/328 |
| 7,431,662 | B2 * | 10/2008 | Tucker, Sr. | A63B 60/00 473/340 |
| 7,614,962 | B1 * | 11/2009 | Clausen | A63B 53/047 473/291 |
| 8,083,607 | B2 * | 12/2011 | Clausen | A63B 53/04 473/291 |
| 8,734,270 | B2 * | 5/2014 | Harrington | A63B 53/04 473/328 |
| 10,137,341 | B2 * | 11/2018 | Greer | A63B 53/06 |
| 10,143,900 | B2 * | 12/2018 | Harrington | A63B 53/047 |
| 10,525,313 | B2 * | 1/2020 | Greer | A63B 60/54 |
| 10,661,131 | B2 * | 5/2020 | Harrington | A63B 53/047 |
| 10,758,793 | B1 * | 9/2020 | Walsh | A63B 53/047 |
| 10,974,108 | B2 * | 4/2021 | Greer | A63B 53/047 |
| 11,931,629 | B2 * | 3/2024 | Breier | A63B 53/0408 |
| 2002/0022532 | A1 * | 2/2002 | Tucker, Sr. | A63B 53/08 473/340 |
| 2002/0042306 | A1 * | 4/2002 | Chappell | A63B 60/00 473/331 |
| 2010/0041493 | A1 * | 2/2010 | Clausen | A63B 60/54 473/328 |
| 2012/0108356 | A1 * | 5/2012 | Harrington | G01B 5/0023 473/328 |
| 2014/0274441 | A1 * | 9/2014 | Greer | A63B 53/047 473/328 |
| 2015/0057096 | A1 * | 2/2015 | Nicolette | A63B 53/047 473/290 |
| 2018/0272198 | A1 * | 9/2018 | Harrington | A63B 53/047 |
| 2019/0070468 | A1 * | 3/2019 | Harrington | A63B 53/047 |
| 2019/0168084 | A1 * | 6/2019 | Seagram | C23C 24/04 |
| 2020/0139211 | A1 * | 5/2020 | Greer | A63B 60/42 |
| 2022/0016495 | A1 * | 1/2022 | Harrington | A63B 53/04 |
| 2023/0211216 | A1 * | 7/2023 | Johnson | A63B 60/42 473/278 |
| 2024/0050815 | A1 | 2/2024 | Breier et al. | |

FOREIGN PATENT DOCUMENTS

| | | | | |
|---|---|---|---|---|
| EP | 4207137 | A1 * | 7/2023 | G09B 19/0038 |
| GB | 2459045 | A * | 10/2009 | A63B 53/065 |
| JP | 2000354644 | | 12/2000 | |
| JP | 2001095960 | | 4/2001 | |
| JP | 2003220160 | | 8/2003 | |
| KR | 20240022402 | A * | 2/2024 | A63B 53/0433 |

* cited by examiner

VARIABLE BOUNCE AND HEEL RELIEF FOR IRONS

CROSS-REFERENCE TO RELATED APPLICATION

This application is a continuation application of U.S. patent application Ser. No. 17/886,052, filed Aug. 11, 2022, which application is incorporated it its entirety here in by this reference.

TECHNICAL FIELD

The present invention relates to a golf club head with an improved sole portion, and, more specifically, a golf club head having a camber radius and/or bounce angle that changes from a toe portion to a heel portion.

BACKGROUND

In the game of golf, a golf club is swung by the golfer to impact a golf ball. The golf club has a head which impacts the golf ball, and a shaft that is grasped and swung by the golfer. There are three basic types of clubs, divided primarily according to the type of head and circumstances of hitting the golf ball. These are: wood clubs to hit the golf ball long distances from an elevated tee; irons (including wedges) to hit the golf ball shorter, more controlled distances with controlled elevations; and putters to hit the golf ball for a short distance along the ground with a high degree of control. The present invention relates principally to irons.

The golfer usually has a set of irons which vary according to the loft angle of the face of the golf club relative to the shaft, with increasing designation numbers being associated with increasing loft angles. The selection of the iron to be used depends upon the distance that the golf ball is to be hit. In each case, however, the golf ball lies on the ground and the golf club is swung with a high velocity so that the club head impacts the ball with high force. The use of irons distinguishes them from the use of woods, where the golf ball is hit from an elevated tee and consequently the head has no or little contact with the ground; as well as from the use of a putter where the velocity of the swing is relatively small.

The front face or striking face of the iron golf club head impacts the golf ball, lying on the ground, either squarely or slightly under the golf ball to project the golf ball on an upward trajectory. The bottom side of the iron club head, called the "sole," either grazes the surface of the ground, which may be grass, turf, sand, or preexisting divots, or actually digs into the ground slightly when the golf ball is struck.

In order to assist a golfer in making a smooth swing, even though the iron's head will make contact with the ground, the sole portion of an iron is designed with bounce, i.e. a downward or descending angle between the leading edge where the face meets the sole and the trailing edge where the sole meets the back portion of the golf club head.

As the golf club passes through the arc of its swing and the leading edge undercuts the ball, the sole will strike the ground. That is, bounce can help prevent the leading edge of the face from digging into the surface on which the golf ball lies, with the resultant loss of force and control. With a positive bounce angle, the resultant force will urge the club head upward to create a "bounce" off the surface. This action helps prevent the face of the club head digging into the turf which typically results in a "muffed" shot and commonly a divot gouged into the turf.

Prior art attempts to improve bounce have resulted in manufacturer's forming irons with a slight, uniform convex curvature throughout the sole, i.e. from heel to toe. While the use of a uniform convex curvature rather than a flat surface has been found to improve bounce characteristics, there remains room in the art for further improvement. What is needed in the art is an improved geometry that increases bounce. Such improved geometry would further increase the versatility of any particular iron, and fine tune the iron to be able to perform better from uneven lies and swing through turfs with minimal resistance.

SUMMARY

The present invention is directed to a golf club head that is finely tuned to perform better from uneven lies and pass through the ground with minimal resistance by varying the camber radius of the sole and/or varying the bounce from the toe portion through the center portion to the heel portion of a golf club head. Therefore, in some embodiments, the camber radius measured at a toe portion can be different from the camber radius measured at a center portion, which in turn can be different from the camber radius measured at a heel portion. Similarly, in some embodiments, the bounce angle measured at the toe portion can be different from the bounce angle measured at the center portion, which in turn, can be different from the bounce angle measured at the heel portion.

In some embodiments, both the camber radius and the bounce angle measured at the toe portion can different from the camber radius and bounce angle measured at the center portion, respectively, which can be different from the camber radius and bounce angle measured at the heel portion, respectively.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention. Furthermore, various inventive features are described below and each can be used independently of one another or in combination with other features.

Figure 1:
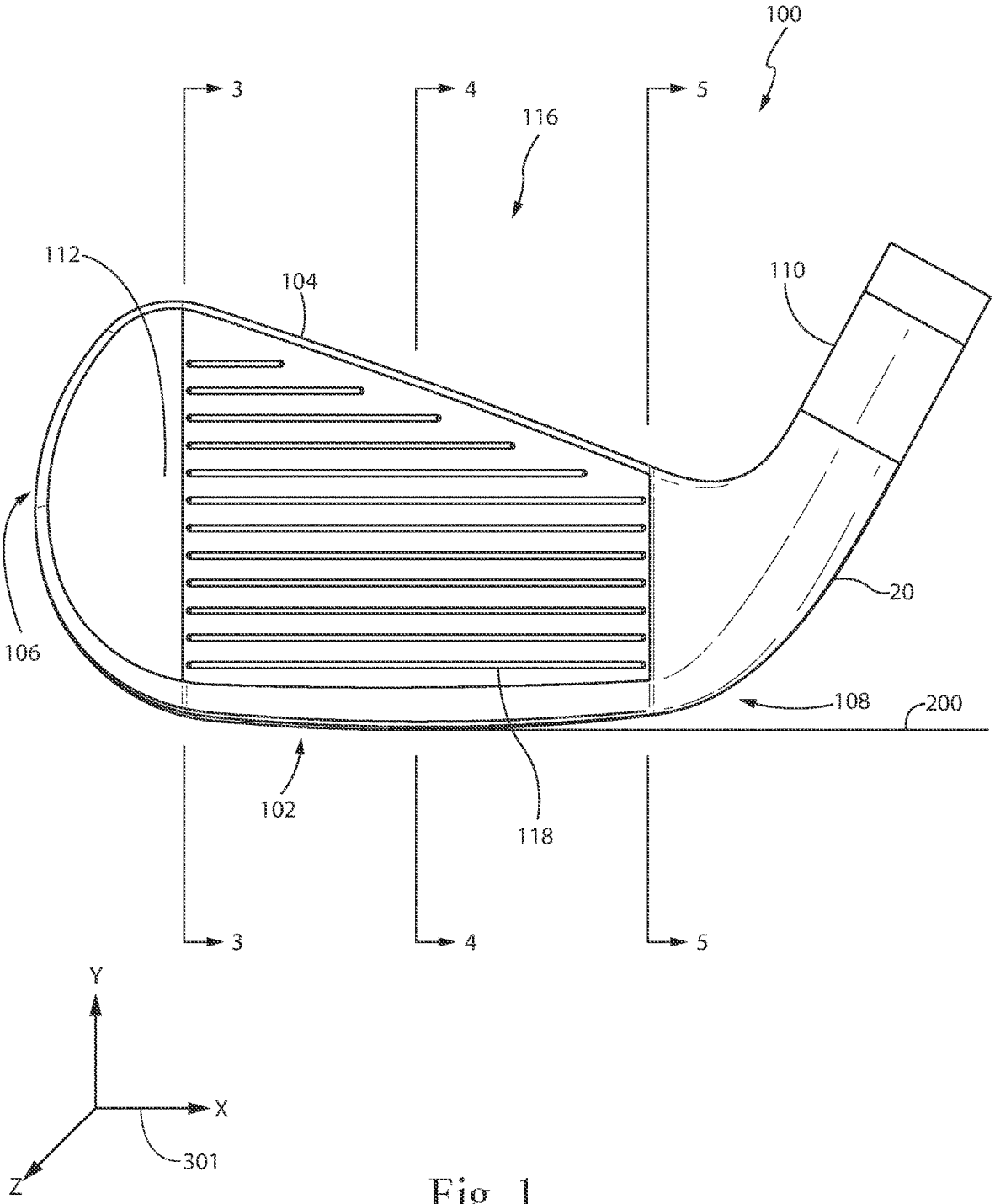
FIG. 1 shows a perspective view of a golf club head in accordance with an exemplary embodiment of the present invention.

FIG. 1 shows a front elevation view of a golf club head 100 in accordance with an exemplary embodiment of the present invention. The golf club head 100 can be any of the various irons (including wedges and hybrids) used in the game of golf, such as the 3 iron, 4 iron, 5 iron, 6 iron, 7 iron, 8 iron, 9 iron, the pitching wedge, sand wedge, and the like. The golf club head 100, as shown in FIG. 1, can generally have a sole 102; a topline 104 opposite the sole 102; a toe portion 106 adjacent to the sole 102 and the topline 104; a heel portion 108 opposite the toe portion 106 and adjacent to the sole 102 and the topline 104; a striking face 112 adjacent to the sole 102, topline 104, toe portion 106, and heel portion 108; a back portion 114 opposite the striking face 112 and adjacent to the sole 102, topline 104, toe portion 106, and heel portion 108; and a hosel 110 adjacent to the heel portion 108 and topline 104. The hosel 110 defines a longitudinal shaft axis A and is configured to receive a shaft. The striking face 112 is further characterized with a plurality of horizontal scorelines 118, which helps control the spin of a golf ball that comes in contact with the striking face 112 of the golf club head 100.

For ease of description, the striking face portion will be referred to as the front side of the golf club head 100. As such, the striking face portion 102 is located at a frontal portion of the golf club head 100. As a result, the back portion 114 is located opposite the striking face portion 112; the topline 104 is located at an upper portion of the golf club head 100; the heel portion 108 is located at a proximal end of the golf club head 100; the toe portion 106 is located at a distal end of the golf club head 100 opposite the heel portion 108; a center portion 116 is located in between the heel portion 108 and the toe portion 106; and the sole 102 is located at a lower portion of the golf club head 100 opposite the topline 104. An axis of origin 201 is provided (for reference only for ease and clarity of description) indicating the x-y-z direction relative to the golf club head 100 in the examples provided.

Figure 2:
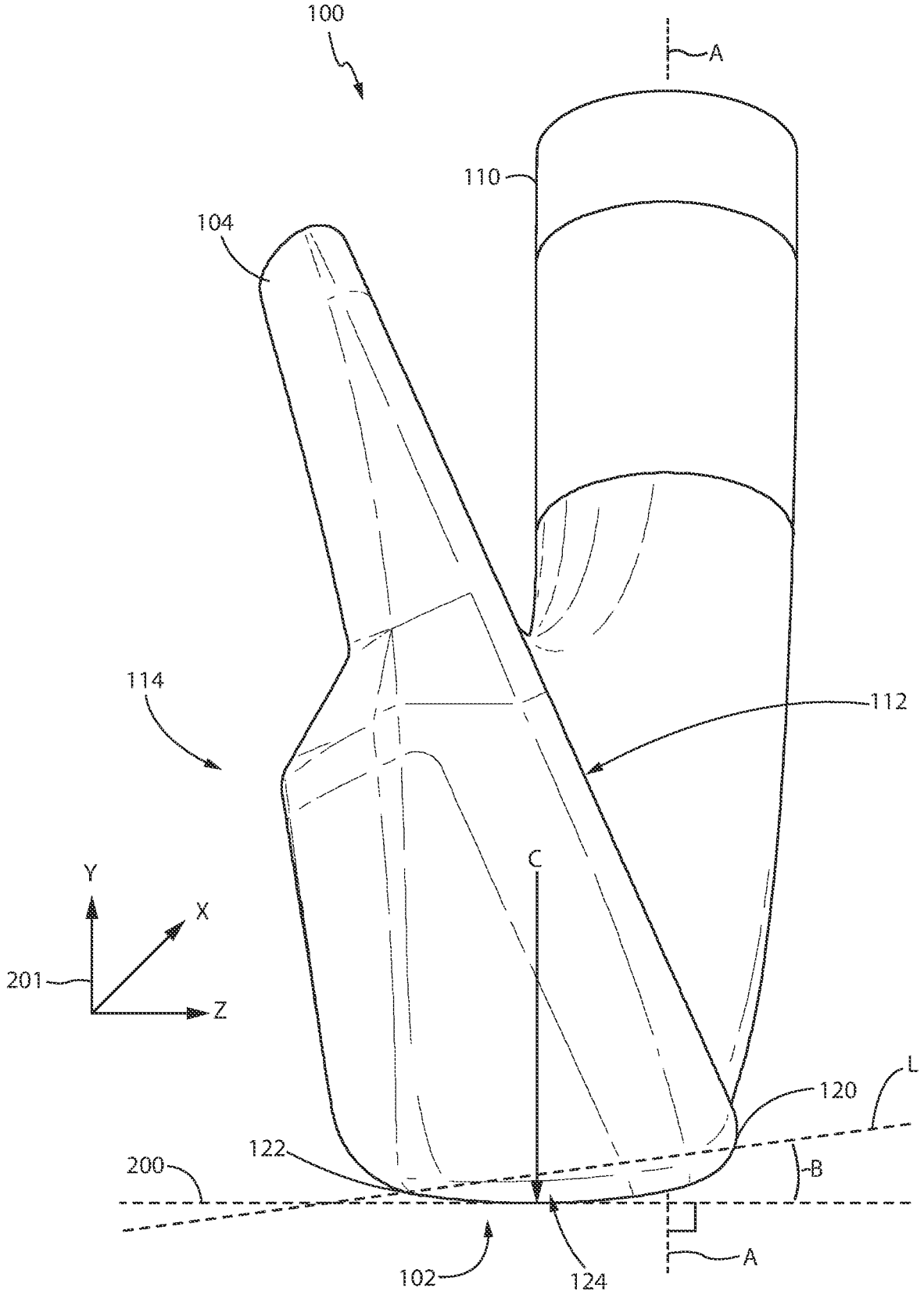
FIG. 2 of the accompanying drawings shows a side view of a golf club head from the toe portion in accordance with an exemplary embodiment of the present invention.

FIG. 2 shows a toe-side view of the golf club head 100 in accordance with an exemplary embodiment of the present invention. As shown in FIG. 2, the golf club head 100 comprises a leading edge 120 located approximately where the striking face 112 meets the sole 102, the leading edge 120 defining a leading edge radius; a trailing edge 122 adjacent to the back portion 114 and the sole 102, the trailing edge 122 having a trailing edge radius; and the sole 102 in between the leading edge 120 and the trailing edge 122, the sole 102 having a camber radius C generally measured from the leading edge 120 to the trailing edge 122.

The leading edge 120 can be defined in the current application as approximately the most forward edge of the golf club head 100, with the hosel 110 in an upright 90 degree (perpendicular) position from a ground plane 200 (in the front-to-back, z-axis direction) as shown in FIG. 2. (The ground plane 200 is an imaginary plane located and in contact with the lowest portion of the golf club head 100, and mimics the surface of the ground upon which the golf ball would lie.) This leading edge 120 is then defined as approximately the forward most edge along the z-axis (as indicated by the axis of origin 201) generally where the striking face 112 meets the sole 102. In addition to illustrating the leading edge 120, FIG. 2 shows the trailing edge 122, which is defined as approximately the most rearward edge of the sole portion 106 of the golf club head 100, again with the hosel 110 in a 90 degree (perpendicular) position from the ground plane 200 (in the front-to-back, z-axis direction). The trailing edge 122 is then defined as approximately the most rearward edge of the sole portion 106 along the z-axis, (referring back to the origin 201) generally where the sole 102 and the back portion 114 meet.

As is known in the art, the leading edge 120 and the trailing edge 122 can be used to characterize the bounce angle B of a club relative to a ground plane 200 when the hosel 110 is in a 90 degree (perpendicular) position from the ground plane 200 (in the front-to-back, z-axis direction) as shown in FIG. 2. In general, the bounce angle B is defined as the angle made relative to the ground plane 200 by an imaginary, straight line L (referred to herein as the bounce line) extending from the leading edge 120 to the trailing edge 122 (i.e. the z-axis direction), and perpendicular to the scorelines 118 (in the x-axis direction).

The invention of the present application incorporates a new and innovative sole profile that dramatically improves the performance of the golf club head 100. The innovative sole 102 comprises a sole profile in which the camber radius C and/or the bounce angle B change, progressing from the toe portion 106 to the heel portion 108. In other words, unlike prior art golf clubs in which the camber radius remains the same from toe to heel, in the present invention, the camber radius $C_T$ measured at the toe portion 106 can be different from the camber radius $C_C$ measured at the center portion 116, which can be different from the camber radius $C_H$ measured at the heel portion 108. Similarly, the bounce angle $B_T$ measured at the toe portion 106 can be different from the bounce angle $B_C$ measured at the center portion 116, which can be different from the bounce angle $B_H$ measured at the heel portion 108.

In some embodiments, the change in camber radius C and/or bounce angle B can be continuous or progressive moving from the toe portion 106 to the heel portion 108. In some embodiments, the change in camber radius C and bounce angle B can be without any identifiable inflection points. This continuously variable camber radius C and/or bounce angle B moving from the toe portion 106 to the heel portion 108 allows for a more fine-tuned adjustment of the specific sole 102 to accommodate the specific needs of the sole 102 at various different points to help improve the performance of the golf club head 100.

As such, the leading edge 120 can be characterized as being comprised of a toe leading edge $\mathbf{120}_T$, a center leading edge $\mathbf{120}_C$, and a heel leading edge $\mathbf{120}_H$. In general, the toe leading edge $\mathbf{120}_T$ is located at the toe portion 106 adjacent to the striking face 112 and the sole 102; the center leading edge $\mathbf{120}_C$ is generally located at the center portion 116 adjacent to the striking face 112 and the sole 102; and the heel leading edge $\mathbf{120}_H$ is generally located at the heel portion 108 adjacent to the striking face 112 and the sole 102.

Similarly, the trailing edge 122 can be characterized as comprising a toe trailing edge $\mathbf{122}_T$, a center trailing edge $\mathbf{122}_C$, and a heel trailing edge $\mathbf{122}_H$. The toe trailing edge $\mathbf{122}_T$ is generally located at the toe portion 106 adjacent to the back portion 114 and the sole 102; the center trailing edge $\mathbf{122}_C$ is generally located at the center portion 116 adjacent to the back portion 114 and the sole 102; and the heel trailing edge $\mathbf{122}_H$ is generally located at the heel portion 108 adjacent to the back portion 114 and the sole 102.

Figure 3:
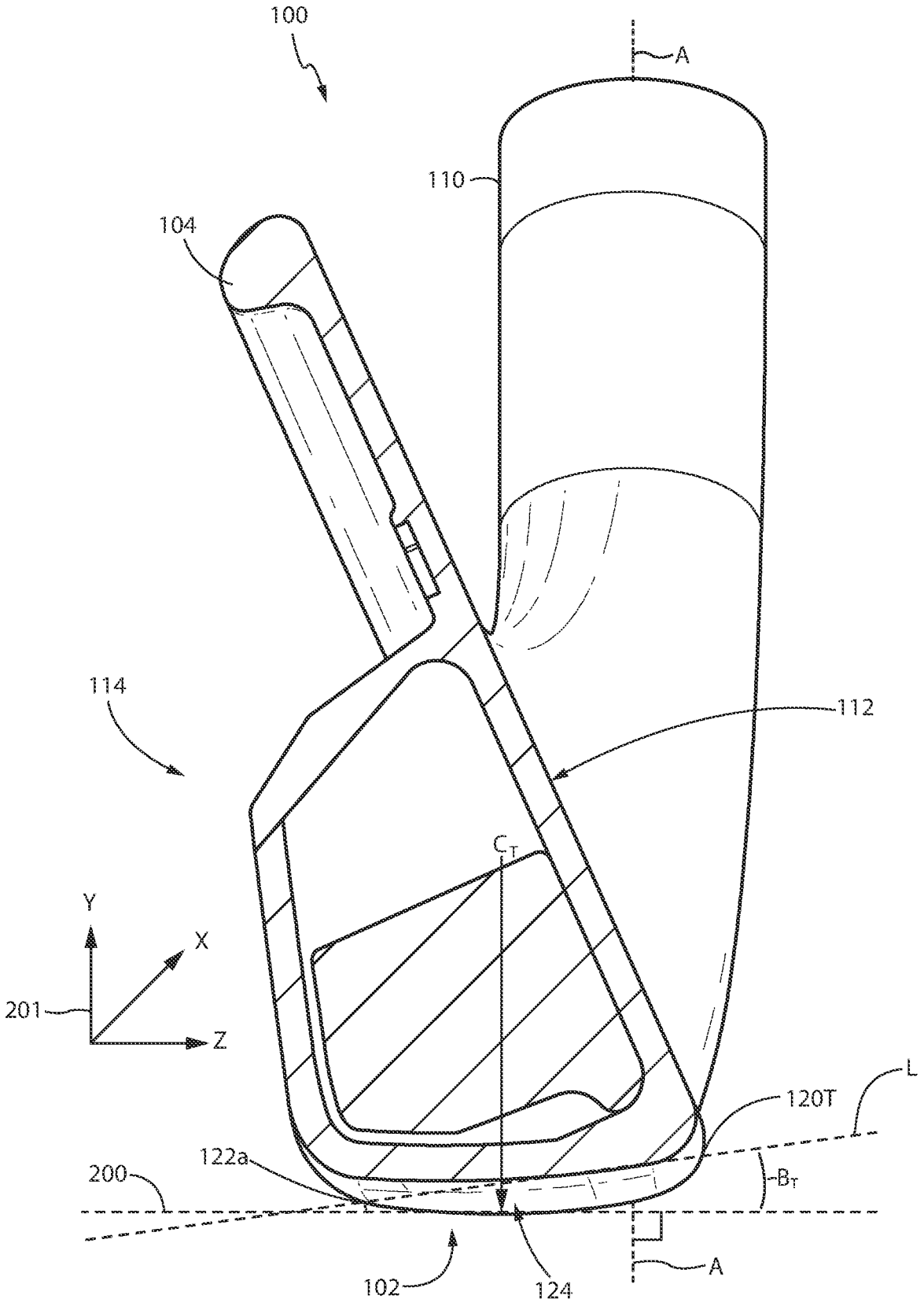
FIG. 3 shows a cross-sectional view through a toe portion of a golf club head in accordance with an exemplary embodiment of the present invention taken along cross-sectional line 3-3 shown in FIG. 1.
Figure 4:
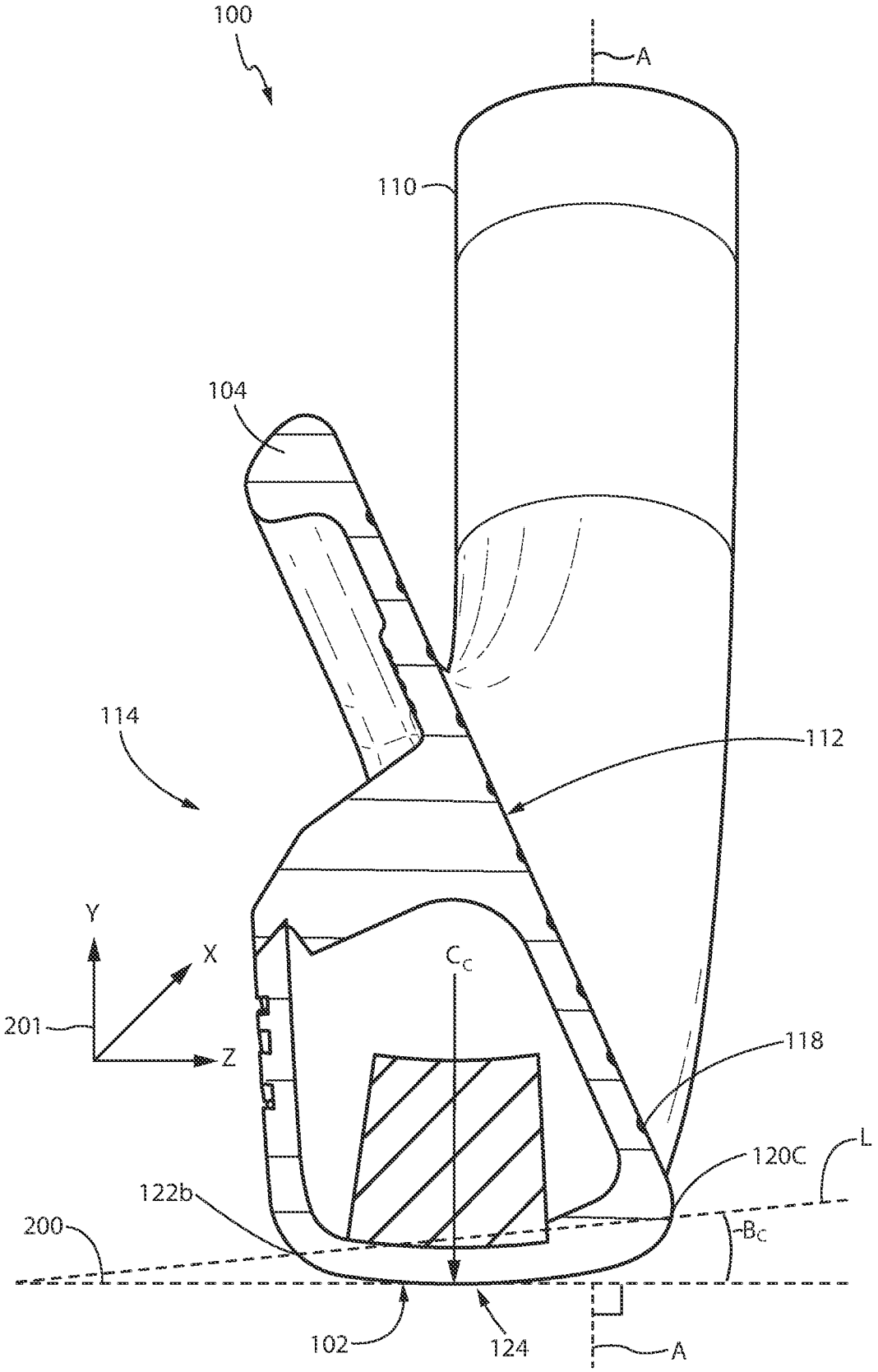
FIG. 4 shows a cross-sectional view through a center portion of a golf club head in accordance with an exemplary embodiment of the present invention taken along cross-sectional line 4-4 shown in FIG. 1.
Figure 5:
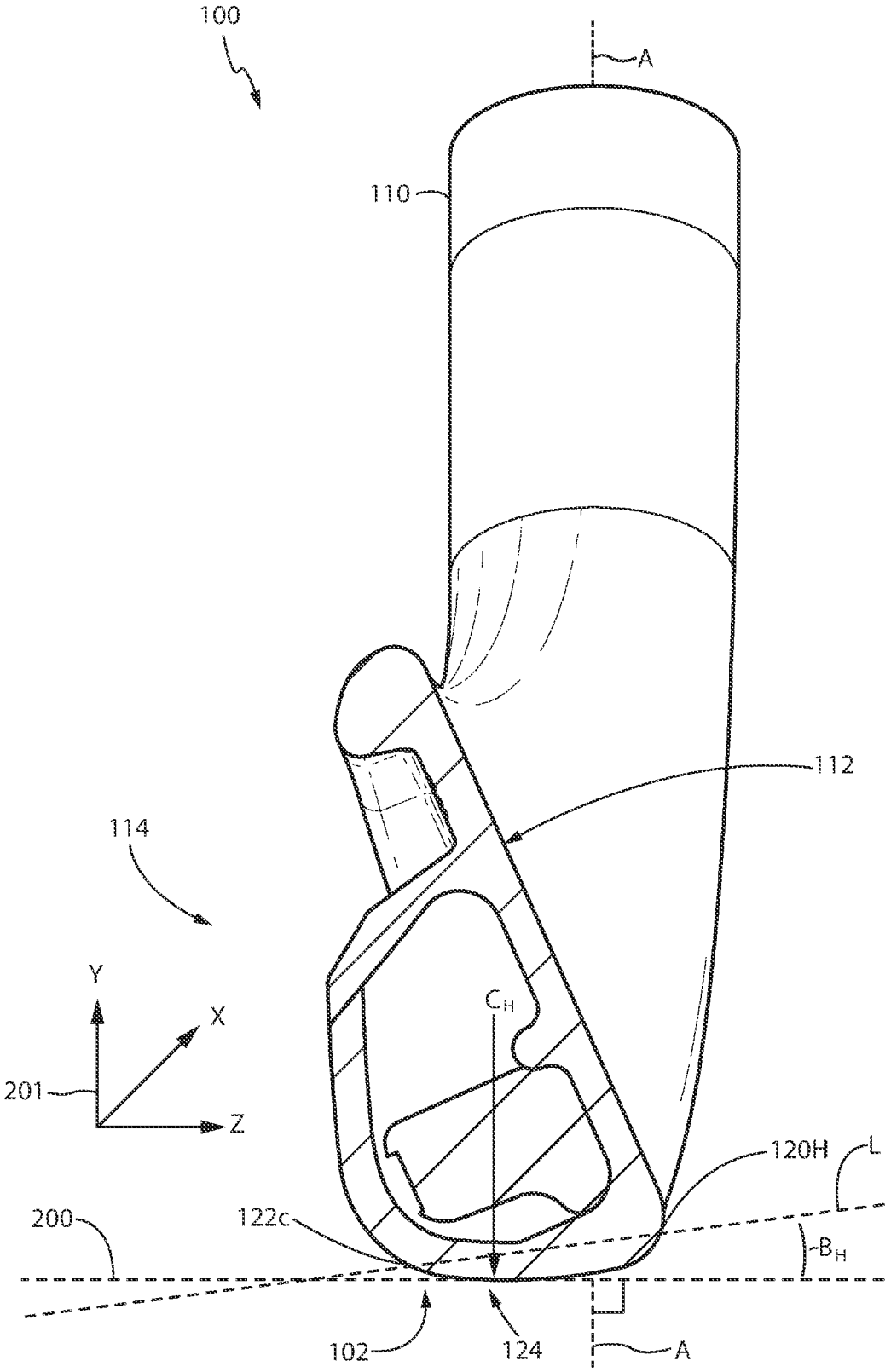
FIG. 5 shows a cross-sectional view through a heel portion of a golf club head in accordance with an exemplary embodiment of the present invention taken along cross-sectional line 5-5 shown in FIG. 1.

Therefore, bounce line L drawn perpendicular to the scoreline 118 from a point on the toe leading edge 120 to a point on the toe trailing edge $\mathbf{122}_T$ can be used to define a toe bounce angle $B_T$. Similarly, a bounce line L drawn perpendicular to the scoreline 118 from a point on the center leading edge $\mathbf{120}_C$ to a point on the center trailing edge $\mathbf{122}_C$ can be used to define a center bounce angle $B_C$. Similarly, a bounce line L drawn perpendicular to the scoreline 118 from a point on the heel leading edge $\mathbf{120}_H$ to a point on the heel trailing edge $\mathbf{122}_H$ can be used to define a heel bounce angle $B_H$.

le;FIGS. 3-5 show cross-sectional views of the golf club head 100 shown in FIG. 1, taken along cross-sectional line 3-3 through the toe portion 106 (FIG. 3), cross-sectional line 4-4 through the center portion 116 (FIG. 4), and cross-sectional line 5-5 through the heel portion 108 (FIG. 5), respectively. These cross-sectional views of the golf club head 100 allows a better illustration of the innovative sole 102 in accordance with the present invention. Line 3-3 generally shows a cut along the y-z plane, placed at a toe-ward location that is generally at the end of the main scorelines 118, which are generally the bottom, longest scorelines 118, adjacent to the toe portion 106. Line 4-4 generally shows a cut along the y-z plane placed at a central location (along the x-axis) generally between the main scorelines 118. Line 5-5 generally shows a cut along the y-z plane placed at a heel-ward location that is generally at the end of the main scorelines 118 adjacent the heel portion 108.

le;Typical golf clubs are designed with the same camber radius and the same bounce angle from the toe portion 106 through the center portion 116 to the heel portion 108. In the invention of the present application, however, the camber radius C changes moving along the sole 102 from the toe portion 106 through the center portion 116 to the heel portion 108 (i.e., along the x-axis). For example, in some embodiments, camber radius C progressively increases from the toe portion 106 to the heel portion 108. In some embodiments, the camber radius C progressively decreases from the toe portion 106 to the heel portion 108. In some embodiments, the camber radius C progressively increases from the toe portion 106 to the center portion 116, then decreases from the center portion 116 to the heel portion 108. In some embodiments, the camber radius C progressively decreases from the toe portion to the center portion 116, then increases from the center portion 116 to the heel portion 108.

le;By way of example only, in a 4 iron, the toe camber radius $C_T$ measured at the distal end of the toe portion 106*a* can be approximately 64 mm. Moving towards the center portion 116, the center camber radius $C_C$ can progressively decrease to approximately 30 mm at about the center point 116*a* of the striking face 112 (e.g., the center point of the lowest scoreline 118). Moving further towards the heel portion 108, the heel camber radius $C_H$ can further decrease to approximately 27 mm at the most proximal point of the heel portion 108. By way of example only, Table 1 shows a chart of a variety of golf club heads 100 showing the changes in the camber radius C (values shown in millimeters) as measured at the toe portion 106 (most distal point of the toe portion 106), the center portion 116 (center of the lowest scoreline 118), and the heel portion 108 (most proximal point of the heel portion 108).

TABLE 1

| | Toe | Center | Heel |
|---|---|---|---|
| 4 iron-1 | 64 | 30 | 27 |
| 4 iron-2 | 70 | 50 | 30 |
| 4 iron-3 | 65 | 38 | 35 |
| 7 iron-1 | 64 | 30 | 27 |
| 7 iron-2 | 70 | 40 | 30 |
| 7 iron-3 | 62 | 35 | 32 |
| PW-1 | 40 | 30 | 27 |
| PW-2 | 60 | 35 | 30 |
| PW-3 | 59 | 32 | 29 |

In the preferred embodiment, the change in the camber radius C from the toe portion 106 to center portion 116 progressively decreases. For example, the camber radius C can decrease from the toe portion 106 to the center portion 116 by about 20% to about 60%. Preferably, the camber radius C can decrease from the toe portion 106 to the center portion 116 by about 25% to about 55%. More preferably, the camber radius C can decrease from the toe portion 106 to the center portion 116 by about 40% to about 50%. In these examples, the percent decrease in camber radius from the toe portion 106 to the center portion 116 is reflected in Equation (1):

$$\text{Percent change} = \left|\left(1 - \frac{\text{Camber Radius at Center}}{\text{Camber Radius at Toe}}\right) \times 100\right| \qquad \text{Eq. (1)}$$

Similarly, the change in camber radius C from the center portion 116 to the heel portion 108 can progressively decrease. For example, the camber radius C can decrease from the center portion 116 to the heel portion by about 5% to about 50%. Preferably, the camber radius C can decrease from the center portion 116 to the heel portion by about 8% to about 40%. More preferably, the camber radius C can decrease from the center portion 116 to the heel portion by about 10% to about 25%. In some embodiments, the camber radius C can decrease from the center portion 116 to the heel portion 108 by about 10% to about 15%. In these examples, the percent decrease in camber radius from the center portion 116 to the toe portion 106 is reflected in Equation (2):

$$\text{Percent change} = \left|\left(1 - \frac{\text{Camber Radius at Heel}}{\text{Camber Radius at Center}}\right) \times 100\right| \qquad \text{Eq. (2)}$$

In the preferred embodiment, the change in the camber radius C from the toe portion 106 to the center portion 116 can be generally greater than the change in camber radius C from the center portion 116 to the heel portion 108. For example, the amount of change in camber radius C from the center portion 116 to the heel portion 108 can be about 15% to about 60% of the amount of change in the camber radius C from the toe portion 106 to the center portion 116. Preferably, the amount of change in camber radius C from the center portion 116 to the heel portion 108 can be about 18% to about 40% of the amount of change in the camber radius C from the toe portion 106 to the center portion 116. More preferably, the amount of change in camber radius C from the center portion 116 to the heel portion 108 can be about 20% to about 40% of the amount of change in the camber radius C from the toe portion 106 to the center portion 116.

In some embodiments, the amount of change in camber radius C from the center portion 116 to the heel portion 108 can be greater than the amount of change in the camber radius C from the toe portion 106 to the center portion 116. For example, the amount of change in camber radius C from the center portion 116 to the heel portion 108 can be about 110% to about 150% of the amount of change in the camber radius C from the toe portion 106 to the center portion 116. Preferably, the amount of change in camber radius C from the center portion 116 to the heel portion 108 can be about 120% to about 140% of the amount of change in the camber radius C from the toe portion 106 to the center portion 116. More preferably, the amount of change in camber radius C from the center portion 116 to the heel portion 108 can be about 125% to about 135% of the amount of change in the camber radius C from the toe portion 106 to the center portion 116.

Similarly, the bounce angle B can change moving along the sole 102 from the toe portion 106 through the center portion 116 to the heel portion 108. For example, in some embodiments, bounce angle B progressively increases from the toe portion 106 to the heel portion 108. In some embodiments, the bounce angle B progressively decreases from the toe portion 106 to the heel portion 108. In some embodiments, the bounce angle B progressively increases from the toe portion 106 to the center portion 116, then decreases from the center portion 116 to the heel portion 108. In some embodiments, the bounce angle B progressively decreases from the toe portion 106 to the center portion 116, then increases from the center portion 116 to the heel portion 108.

By way of example only, in a 4 iron, the toe bounce angle $B_T$ measured at the toe portion 106 can be approximately 2 degrees. Moving towards the center portion 116, the center bounce angle $B_C$ can progressively decrease to approximately 1 degree. Moving further towards the heel portion 108, the heel bounce angle $B_H$ can further decrease to approximately 0 degree. In another example, bounce angle can decrease from the toe portion 106 through the center portion 116 to the heel portion 108 from 3 degrees to 2 degrees to 1 degree, respectively.

Examples of a bounce angle B increasing are demonstrated by a 4 iron having a bounce angle B increasing from the toe portion 106 to the center portion 116 from about 3 degrees to about 4 degrees. In a 7 iron, the bounce angle B can increase from the toe portion 106 to the center portion 116 from about 6 degrees to about 7 degrees. In a pitching wedge (PW), the bounce angle B can increase from the toe portion 106 to the center portion 116 from about 9 degrees to about 10 degrees.

Examples of the bounce angle B increasing from the center portion 116 to the heel portion 108 include a 4 iron having a bounce angle B that changes from 4 degrees to 5 degrees from the center portion 116 to the heel portion. In a 7 iron, the bounce angle B can increase from the center portion 116 to the heel portion 108 from about 7 degrees to about 8 degrees. In a pitching wedge, the bounce angle B can increase from the center portion 116 to the heel portion 108 from about 10 degrees to about 11 degrees.

Table 2 shows a chart of the same golf club heads from Table 1, but now showing the changes in the bounce angle B (values shown in degrees) as measured at the toe portion 106 (most distal point of the toe portion 106), center portion 116 (center of the lowest scoreline 118), and the heel portion 108 (most proximal point of the heel portion 108).

TABLE 2

| | Toe | Center | Heel |
|---|---|---|---|
| 4 iron-1 | 2 | 1 | 0 |
| 4 iron-2 | 3 | 4 | 5 |
| 4 iron-3 | 3 | 2 | 1 |
| 7 iron-1 | 3 | 2 | 1 |
| 7 iron-2 | 6 | 7 | 8 |
| 7 iron-3 | 6 | 5 | 4.5 |
| PW-1 | 4 | 5 | 2 |
| PW-2 | 9 | 10 | 11 |
| PW-3 | 10 | 8 | 6.5 |

As such, the change (either increasing or decreasing) in the bounce angle B from the toe portion 106 to center portion 116 and/or from the center portion 116 to the heel portion 108 can range from about 0.25 degree to about 5 degrees in each region. Preferably, the change (either increasing or decreasing) in the bounce angle B from the toe portion 106 to center portion 116 and/or from the center portion 116 to the heel portion 108 can range from about 0.5 degree to about 4 degrees in each region. More preferably, the change (either increasing or decreasing) in the bounce angle B from the toe portion 106 to center portion 116 and/or from the center portion 116 to the heel portion 108 can range from about 1 degrees to about 3 degrees in each region.

In general, the bounce angle B from the toe portion 106 to the center portion 116 can decrease (relative to the toe portion 106) by about 10% to about 60%. In some embodiments, the bounce angle B from the toe portion 106 to the center portion 116 can decrease by about 15% to about 50%. In some embodiments, the bounce angle B from the toe portion 106 to the center portion 116 can decrease by about 20% to about 35%.

In some embodiments, the bounce angle B from the toe portion 106 to the center portion 116 can increase by about 10% to about 40%. In some embodiments, the bounce angle B from the toe portion 106 to the center portion 116 can increase by about 17% to about 33%. In some embodiments, the bounce angle B from the toe portion 106 to the center portion 116 can increase by about 20% to about 30%. In these examples, the percent change in the bounce angle B (whether increasing or decreasing) from the toe portion 106 to the center portion 116 is reflected in Equation (3):

$$\text{Percent change} = \left|\left(1 - \frac{\text{Bounce Angle at Center}}{\text{Bounce Angle at Toe}}\right) \times 100\right| \quad \text{Eq. (3)}$$

Similarly, the bounce angle B from the center portion 116 to the heel portion 108 can decrease by about 5% to about 70%. In some embodiments, the bounce angle B from the center portion 116 to the heel portion 108 can decrease by about 10% to about 60%. In some embodiments, the bounce angle B from the center portion 116 to the heel portion 108 can decrease by about 18% to about 50%.

In some embodiments, the bounce angle B from the center portion 116 to the heel portion 108 can increase by about 5% to about 30%. In some embodiments, the bounce angle B from the center portion 116 to the heel portion 108 can increase by about 10% to about 25%. In some embodiments, the bounce angle B from the center portion 116 to the heel portion 108 can increase by about 14% to about 20%. In these examples, the percent change in the bounce angle B (whether increasing or decreasing) from the center portion 116 to the heel portion 108 is reflected in Equation (4):

$$\text{Percent change} = \left|\left(1 - \frac{\text{Bounce Angle at Heel}}{\text{Bounce Angle at Center}}\right) \times 100\right| \quad \text{Eq. (4)}$$

The invention of the present application can be further characterized by the relationship between the bounce angle B and the camber radius C. In some embodiments, the ratio of the toe bounce angle $B_T$ to the toe camber radius $C_T$ ($B_T$:$C_T$) can range from about 0.02:1 to about 0.2:1. In some embodiments, the ratio of the toe bounce angle $B_T$ to the toe camber radius $C_T$ ($B_T$:$C_T$) can range from about 0.03:1 to about 0.17:1. In some embodiments, the ratio of the toe bounce angle $B_T$ to the toe camber radius $C_T$ ($B_T$:$C_T$) can range from about 0.04:1 to about 0.15:1. In some embodiments, the ratio of the toe bounce angle $B_T$ to the toe camber radius $C_T$ ($B_T$:$C_T$) can range from about 0.05:1 to about 0.1:1.

In some embodiments, the ratio of the center bounce angle $B_C$ to the center camber radius $C_C$ ($B_C$:$C_C$) can range from about 0.02:1 to about 0.4:1. In some embodiments, the ratio of the center bounce angle $B_C$ to the center camber radius $C_C$ ($B_C$:$C_C$) can range from about 0.03:1 to about 0.30:1. In some embodiments, the ratio of the center bounce angle $B_C$ to the center camber radius $C_C$ ($B_C$:$C_C$) can range from about 0.05:1 to about 0.18:1. In some embodiments, the ratio of the center bounce angle $B_C$ to the center camber radius $C_C$ ($B_C$:$C_C$) can range from about 0.06:1 to about 0.15:1.

In some embodiments, the ratio of the heel bounce angle $B_H$ to the heel camber radius $C_H$ ($B_H$:$C_H$) can range from about 0:1 to about 0.4:1. In some embodiments, the ratio of the heel bounce angle $B_H$ to the heel camber radius $C_H$ ($B_H$:$C_H$) can range from about 0.02:1 to about 0.37:1. In some embodiments, the ratio of the heel bounce angle $B_H$ to the heel camber radius $C_H$ ($B_H$:$C_H$) can range from about 0.04:1 to about 0.27:1. In some embodiments, the ratio of the heel bounce angle $B_H$ to the heel camber radius $C_H$ ($B_H$:$C_H$) can range from about 0.07:1 to about 0.22:1.

In the preferred embodiment, the bounce B to camber C ratio at the center ($B_C$:$C_C$) is greater than the bounce B to camber C ratio at the toe ($B_T$:$C_T$) or at the heel ($B_H$:$C_H$). In some embodiments, the bounce B to camber C ratio at the heel ($B_H$:$C_H$) can be greater than the bounce B to camber C ratio at the center ($B_C$:$C_C$).

The invention of the present application can be further characterized by the relationship between the change in bounce angle B and the change in camber radius C. For example, in the preferred embodiments, the percent change in the bounce angle B from the toe portion 106 to the center portion 116 is generally smaller than the percent change of the camber radius C from the toe portion 106 to the center portion 116. In some embodiments, the change in bounce angle B from the toe portion 106 to the center portion 116 (whether the change is increasing or decreasing) can be about 25% to about 100% of the change in camber radius C from the same or corresponding toe portion 106 to the center portion 116. For example, a 40% change in the camber radius C from the toe portion 106 to the center portion 116, with a 10% change in the bounce angle B measured at the corresponding toe portion 106 and the center portion 116, results in the change in bounce angle B to be 25% of the change in the camber radius C from the toe portion 106 to the center portion 116. Likewise, a 25% change in the camber radius C from the toe portion 106 to the center portion 116 with a 25% change in the bounce angle B from the same toe portion 106 to the center portion 116, results in the change in the bounce angle B being 100% of the change in the camber radius C from the toe portion 106 to the center portion 116. In some embodiments, the change in bounce angle B from the toe portion 106 to the center portion 116 (whether the change is increasing or decreasing) can be about 35% to about 95% of the change in camber radius C from the corresponding toe portion 106 to the center portion 116. In some embodiments, the change in bounce angle B from the toe portion 106 to the center portion 116 (whether the change is increasing or decreasing) can be about 40% to about 80% of the change in camber radius C from the same or corresponding toe portion 106 to the center portion 116. In some embodiments, the change in bounce angle B from the toe portion 106 to the center portion 116 (whether the change is increasing or decreasing) can be about 43% to about 65% of the change in camber radius C from the same or corresponding toe portion 106 to the center portion 116.

In some embodiments, the percent change in the bounce angle B from the toe portion 106 to the center portion 116 can be greater than the percent change of the camber radius C from the toe portion 106 to the center portion 116. For example, in a club in which the bounce angle from the toe portion 106 to the center portion changed by about 33%, and the camber radius changed by about 29% in the corresponding toe portion 106 to the center portion 116, the result is a change in the bounce angle B being about 114% of the change in the camber radius C. In some embodiments, the change in bounce angle B from the toe portion 106 to the center portion 116 (whether the change is increasing or decreasing) can be up to about 125% of the change in camber radius C from the same or corresponding toe portion 106 to the center portion 116. In some embodiments, the change in bounce angle B from the toe portion 106 to the center portion 116 (whether the change is increasing or decreasing) can be up to about 120% of the change in camber radius C from the same or corresponding toe portion 106 to the center portion 116. In some embodiments, the change in bounce angle B from the toe portion 106 to the center portion 116 (whether the change is increasing or decreasing) can be up to about 116% of the change in camber radius C from the same or corresponding toe portion 106 to the center portion 116.

For the center portion 116 to the heel portion 108, the percent change in the bounce angle B from the center portion 116 to the heel portion 108 can be smaller or greater than the percent change of the camber radius C from the corresponding center portion 116 to the heel portion 108. For example, a 14% change in the camber radius C from the center portion 116 to the heel portion 108, with a 10% change in the bounce angle B measured at the corresponding center portion 116 to the heel portion 108, results in the change in bounce angle B being about 70% of the change in the camber radius C from the center portion 116 to the heel portion 108. In some embodiments, the change in bounce angle B from the center portion 116 to the heel portion 108 (whether the change is increasing or decreasing) can be about 45% to about 80% of the change in camber radius C from the same or corresponding center portion 116 to the heel portion 108. In some embodiments, the change in bounce angle B from the center portion 116 to the heel portion 108 (whether the change is increasing or decreasing) can be about 50% to about 70% of the change in camber radius C from the corresponding center portion 116 to the heel portion 108. In some embodiments, the change in bounce angle B from the center portion 116 to the heel portion 108 (whether the change is increasing or decreasing) can be about 55% to about 65% of the change in camber radius C from the corresponding toe portion 106 to the center portion 116.

In some embodiments, the percent change in the bounce angle B from the center portion 116 to the heel portion 108 can be greater than the percent change of the camber radius C from the corresponding center portion 116 to the heel portion 108. For example, in a club in which the bounce angle from the center portion 116 to the heel portion 108 changed by about 50%, and the camber radius changed by about 10% in the corresponding center portion 116 to the heel portion 108, the change in bounce angle B is about 500% of the change in the camber radius C. In some embodiments, the change in bounce angle B from the center portion 116 to the heel portion 108 (whether the change is increasing or decreasing) can be from about 100% to about 1000% of the change in camber radius C from the corresponding center portion 116 to the heel portion 108. In some embodiments, the change in bounce angle B from the center portion 116 to the heel portion 108 (whether the change is increasing or decreasing) can be about 110% to about 650% of the change in camber radius C from the corresponding center portion 116 to the heel portion 108. In some embodiments, the change in bounce angle B from the center portion 116 to the heel portion 108 (whether the change is increasing or decreasing) can be about 200% to about 600% of the change in camber radius C from the corresponding center portion 116 to the heel portion 108.

Preferably, when the bounce angle B decreases from the center portion 116 to the heel portion 108, the percent change in the bounce angle B is greater than the percent change of the camber radius C at the corresponding locations. Conversely, when the bounce angle B increases from the center portion 116 to the heel portion 108, the percent change of the bounce angle B is less than the percent change of the camber radius C at the corresponding locations.

Decreasing the bounce angle B moving towards the heel portion 108 also results in heel relief. Relief in the heel portion 108 can improve how well the club head 100 passes through the grass, turf, sand, etc., with minimal resistance.

The golf club head 100 of the present invention can be manufactured using casting or forging technology according to the specification disclosed herein using materials such as titanium, steel, carbon fiber, and other typical metals used in manufacturing irons.

Other than in the operating examples, or unless otherwise expressly specified, all of the numerical ranges, amounts, values and percentages such as those for radius of curvature, angles, and others in the aforementioned portions of the specification may be read as if prefaced by the word "about" or "approximately" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values, and any values in between any ranges cited, may be used.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A golf club head, comprising:

a) a striking face located at a frontal portion of the golf club head, the striking face having a plurality of scorelines;

b) a back portion located opposite the striking face;

c) a topline located at an upper portion of the golf club head;

d) a heel portion located at a proximal end of the golf club head;

e) a hosel adjacent to the heel portion and the topline, the hosel defining a longitudinal axis and configured to receive a shaft;

f) a toe portion located at a distal end of the golf club head opposite the heel portion;

g) a center portion located in between the heel portion and the toe portion;

h) a sole located at a lower portion of the golf club head opposite the topline, the sole having a camber radius;

i) a leading edge adjacent to the striking face and the sole;

j) a trailing edge adjacent to the back portion and the sole, wherein the camber radius is measured from the leading edge to the trailing edge; and k) wherein the camber radius changes from the toe portion to the heel portion, l) Wherein a bounce line from the leading edge to the trailing edge defines a bounce angle with a ground plane when the longitudinal axis of the hosel is oriented perpendicular to the ground plane, and the bounce angle changes from the toe portion to the heel portion.

2. The golf club head of claim 1, wherein the camber radius progressively increases from the toe portion to the heel portion.

3. The golf club head of claim 1, wherein the camber radius progressively increases from the toe portion to the center portion, then decreases from the center portion to the heel portion.

4. The golf club head of claim 1, wherein the camber radius progressively decreases from the toe portion to the center portion, then increases from the center portion to the heel portion.

5. The golf club head of claim 1, wherein the bounce angle progressively increases from the toe portion to the heel portion.

6. The golf club head of claim 1, wherein the bounce angle progressively decreases from the toe portion to the heel portion.

7. The golf club head of claim 1, wherein the bounce angle progressively increases from the toe portion to the center portion, then decreases from the center portion to the heel portion.

8. The golf club head of claim 1, wherein the bounce angle progressively decreases from the toe portion to the center portion, then increases from the center portion to the heel portion.

9. The golf club head of claim 1, wherein a first ratio of a change in a toe bounce angle measured at the toe portion to a change in a toe camber radius measured at the toe portion ranges from about 0.02:1 to about 0.2:1, wherein a second ratio of a change in a center bounce angle measured at the center portion to a change in a center camber radius measured at the center portion ranges from about 0.02:1 to about 0.4:1, and wherein a third ratio of a change in a heel bounce angle measured at the heel portion to a change in a heel camber radius measured at the heel portion ranges from about 0:1 to about 0.4:1.

10. The golf club head of claim 1, wherein a first ratio of a center bounce angle to a center camber radius measured at the center portion is greater than a second ratio of a toe bounce angle to a toe camber radius measured at the toe portion, and greater than a third ratio of a heel bounce angle to a heel camber radius measured at the heel portion.

11. The golf club head of claim 1, wherein a percent change of the bounce angle measured at the toe portion compared to the center portion is about 25% to about 100% of a percent change of the camber radius measured at the toe portion compared to the center portion.

12. The golf club head of claim 1, wherein a percent change of the bounce angle measured at the toe portion compared to the center portion is about 100% to about 125% of a percent change of the camber radius measured at the toe portion compared to the center portion.

13. The golf club head of claim 1, wherein a percent change of the bounce angle measured at the center portion compared to the heel portion is about 45% to about 80% of a percent change of the camber radius measured at the center portion compared to the heel portion.

14. The golf club head of claim 1, wherein a percent change of the bounce angle measured at the center portion compared to the heel portion is about 100% to about 650% of a percent change of the camber radius measured at the center portion compared to the heel portion.

15. A golf club head, comprising:

a) a striking face located at a frontal portion of the golf club head, the striking face having a plurality of scorelines;

b) a back portion located opposite the striking face;

c) a topline located at an upper portion of the golf club head;

d) a heel portion located at a proximal end of the golf club head;

e) a hosel adjacent to the heel portion and the topline, the hosel configured to receive a shaft;

f) a toe portion located at a distal end of the golf club head opposite the heel portion;

g) a center portion located in between the heel portion and the toe portion;

h) a sole located at a lower portion of the golf club head opposite the topline;

i) a leading edge adjacent to the striking face and the sole;

j) a trailing edge adjacent to the back portion and the sole, k) wherein the sole defines a camber radius from the leading edge to the trailing edge, wherein the camber radius changes when measured from the toe portion compared to when measured from the heel portion, wherein the camber radius progressively increases from the toe portion to the center portion, then decreases from the center portion to the heel portion.

16. The golf club head of claim 15, wherein a change in the camber radius from the center portion to the heel portion is about 15% to about 60% of a change in the camber radius from the toe portion to the center portion.

17. The golf club head of claim 15, wherein a change in the camber radius from the center portion to the heel portion is about 110% to about 150% of a change in the camber radius from the toe portion to the center portion.

18. The golf club head of claim 15, wherein the camber radius measured at the center portion decreases by about 5% to about 50% at the heel portion.

19. A golf club head, comprising:

a) a striking face located at a frontal portion of the golf club head, the striking face having a plurality of scorelines;

b) a back portion located opposite the striking face;

c) a topline located at an upper portion of the golf club head;

d) a heel portion located at a proximal end of the golf club head;

e) a hosel adjacent to the heel portion and the topline, the hosel defining a longitudinal axis and configured to receive a shaft;

f) a toe portion located at a distal end of the golf club head opposite the heel portion;

g) a center portion located in between the heel portion and the toe portion;

h) a sole located at a lower portion of the golf club head opposite the topline;

i) a leading edge adjacent to the striking face and the sole; and j) a trailing edge adjacent to the back portion and the sole, k) wherein a bounce line from the leading edge to the trailing edge defines a bounce angle with a ground plane when the hosel is oriented perpendicular to the ground plane, and wherein the bounce angle changes from the toe portion to the heel portion.

20. The golf club head of claim 19, wherein the bounce angle progressively increases from the toe portion to the heel portion.

21. The golf club head of claim 19, wherein the bounce angle progressively increases from the toe portion to the center portion, then decreases from the center portion to the heel portion.

22. The golf club head of claim 19, wherein the bounce angle progressively decreases from the toe portion to the center portion, then increases from the center portion to the heel portion.

23. The golf club head of claim 19, wherein the bounce angle measured at the toe portion decreases by about 15% to about 60% at the center portion.

24. The golf club head of claim 19, wherein the bounce angle measured at the center portion decreases by about 5% to about 70% at the heel portion.

25. The golf club head of claim 19, wherein the bounce angle measured at the toe portion increases by about 10% to about 40% at the center portion.

26. The golf club head of claim 19, wherein the bounce angle measured at the center portion increases by about 5% to about 30% at the heel portion.

* * * * *